US010989482B2

(12) United States Patent
Granryd et al.

(10) Patent No.: US 10,989,482 B2
(45) Date of Patent: Apr. 27, 2021

(54) HEAT EXCHANGING PLATE AND HEAT EXCHANGER

(71) Applicant: ALFA LAVAL CORPORATE AB, Lund (SE)

(72) Inventors: Erik Gustav Ulrik Granryd, Täby (SE); Marcello Masgrau, Copenhagen (DK)

(73) Assignee: ALFA LAVAL CORPORATE AB, Lund (SE)

( * ) Notice: Subject to any disclaimer, the term of this patent is extended or adjusted under 35 U.S.C. 154(b) by 16 days.

(21) Appl. No.: 16/473,564

(22) PCT Filed: Feb. 16, 2017

(86) PCT No.: PCT/EP2017/053556
§ 371 (c)(1),
(2) Date: Jun. 25, 2019

(87) PCT Pub. No.: WO2018/133954
PCT Pub. Date: Jul. 26, 2018

(65) Prior Publication Data

US 2019/0331426 A1 Oct. 31, 2019

(30) Foreign Application Priority Data

Jan. 19, 2017 (EP) ..... 17152268

(51) Int. Cl.
*F28D 9/00* (2006.01)
*F28F 3/04* (2006.01)
*F28D 21/00* (2006.01)

(52) U.S. Cl.
CPC ..... *F28D 9/005* (2013.01); *F28F 3/044* (2013.01); *F28F 3/046* (2013.01); *F28D 2021/0059* (2013.01); *F28D 2021/0063* (2013.01)

(58) Field of Classification Search
CPC ..... F28F 3/044; F28F 3/046; F28D 9/005; F28D 2021/0059; F28D 2021/0063
See application file for complete search history.

(56) References Cited

U.S. PATENT DOCUMENTS 4,688,631 A 8/1987 Peze et al.
4,781,248 A 11/1988 Pfeiffer
(Continued)

FOREIGN PATENT DOCUMENTS

CN 1656351 A 8/2005
CN 1993597 A 7/2007
(Continued)

OTHER PUBLICATIONS

English translation of the Chinese Office Action and Search Report for Chinese Application No. 201780083995.4, dated Apr. 10, 2020.
(Continued)

*Primary Examiner* — Devon Russell
(74) *Attorney, Agent, or Firm* — Birch, Stewart, Kolasch & Birch LLP

(57) ABSTRACT

A plate for a heat exchanger between a first medium and a second medium, with a main plane of extension and a main longitudinal direction includes a first heat transfer surface, parallel to said main plane and in contact with the first medium; and a second heat transfer surface, parallel to said main plane and in contact with the second medium. The first surface includes a first medium inlet region, a first medium transfer region and a first medium outlet region including a first medium outlet port. The second surface includes a second medium inlet region, a second medium transfer region and a second medium outlet region, which second medium inlet region overlaps with the first medium outlet region and includes a second medium inlet port not overlapping, with the first medium outlet port. The first medium outlet region includes a protruding ridge extending from a
(Continued)

respective edge of the first surface and perpendicularly to the longitudinal direction, and the protruding ridges form a barrier system for the first medium and define a channel along which the first medium is forced to travel, which channel runs first towards, then around and thereafter away from the second medium inlet port.

22 Claims, 12 Drawing Sheets

(56) References Cited

U.S. PATENT DOCUMENTS

| | | | | |
|---|---|---|---|---|
| 6,389,696 | B1 | 5/2002 | Heil et al. | |
| 2002/0026999 | A1* | 3/2002 | Wu | F28D 9/0012 165/167 |
| 2007/0089871 | A1* | 4/2007 | Andersson | F28D 9/005 165/167 |
| 2012/0125583 | A1* | 5/2012 | Persson | F28D 9/005 165/170 |
| 2016/0245591 | A1* | 8/2016 | Masgrau | F28F 3/046 |
| 2016/0356560 | A1* | 12/2016 | Wei | F28F 9/026 |
| 2017/0106639 | A1* | 4/2017 | Vandermeulen | F28F 3/10 |
| 2017/0219296 | A1* | 8/2017 | Wei | F28F 3/048 |

FOREIGN PATENT DOCUMENTS

| | | | | |
|---|---|---|---|---|
| CN | 103822521 | A | 5/2014 | |
| DE | 195 47 185 | A1 | 6/1997 | |
| DE | 197 16 845 | A1 | 10/1998 | |
| DE | 10049890 | A1 * | 4/2002 | F28D 9/005 |
| DE | 100 49 890 | B4 | 2/2007 | |
| EP | 0 252 275 | A2 | 1/1988 | |
| EP | 0 252 275 | A3 | 3/1988 | |
| EP | 0 186 592 | B1 | 10/1988 | |
| EP | 1 091 185 | A3 | 6/2003 | |
| EP | 1 376 042 | A2 | 1/2004 | |
| EP | 1 376 042 | A3 | 6/2006 | |
| EP | 1783450 | A1 | 5/2007 | |
| EP | 1497603 | B1 | 4/2008 | |
| EP | 1 630 510 | B2 | 3/2014 | |
| EP | 3115732 | A1 | 1/2017 | |
| EP | 3 306 253 | A1 | 4/2018 | |
| JP | 2013-130300 | A | 7/2013 | |
| JP | 2015-194324 | A | 11/2015 | |
| KR | 10-2016-0070762 | A | 8/2016 | |
| WO | WO 2009/112031 | A2 | 9/2009 | |
| WO | WO 2015/057115 | A1 | 4/2015 | |

OTHER PUBLICATIONS

English translation of the Korean Office Action, dated Aug. 21, 2020, for Korean Application No. 10-2019-7023504.

International Preliminary Report on Patentability, issued in PCT/EP2017/053556, dated Jan. 2, 2019.

International Search Report, issued in PCT/EP2017/053556, dated Oct. 30, 2017.

Written Opinion of the International Searching Authority, issued in PCT/EP2017/053556, dated Oct. 30, 2017.

* cited by examiner

HEAT EXCHANGING PLATE AND HEAT EXCHANGER

The present invention relates to a heat exchanger plate, as well as to a heat exchanger comprising a plurality of such plates. In particular, the present invention is useful in a condenser-type plate heat exchanger.

Heat exchangers of different types are used in many different applications. A particular type of prior art heat exchanger is a plate heat exchanger, in which flow channels of different media to be heat exchanged are formed between adjacent heat exchanging plates in a stack of such plates, and in particular delimited by corresponding heat exchanging surfaces on such plates.

In particular, it has turned out that plate heat exchangers can advantageously be manufactured from relatively thin, stamped sheet metal pieces, which metal pieces can be joined to form the heat exchanger. Such heat exchangers can be made relatively efficient.

The prior art comprises, inter alia, WO2009112031A3, EP1630510B2 and EP1091185A3, describing heat exchangers with plates fishbone-shaped protrusion patterns.

Furthermore, EP0186592B1 describes a plate heat exchanger with dimple-provided plates.

The European patent application EP16192854.4, which has not yet been published at the time of filing of the present application, describes a heat exchanger plate and a heat exchanger designed to solve problems in such prior art heat exchangers regarding insufficient mechanical stability; heat exchanging efficiency under a given maximum acceptable pressure drop across the heat exchanger; and minimization of the amount of used heat medium.

The present inventions solves the additional problem of achieving an efficient cooling of a heat medium being cooled in a plate heat exchanger of the general type disclosed in said unpublished European patent application, while maintaining overall heat exchanging efficiency, mechanical stability and minimization of used amount of heat medium. In particular, the present invention achieves these aims in case the heat exchanger is a condenser, and in case the said cooled heat medium is first condensed and thereafter subcooled, to a temperature below the condensation temperature of the medium in question. Further particularly, these advantages are achieved in the preferred case in which the subcooled heat medium is a refrigerant, for instance used in a thermodynamically operating cooling machine.

Further previous publications include WO2015057115A1, disclosing a heat exchanger with channels for improved heat medium cooling; DE19547185A1, disclosing a turbulence-increasing element in a plate exchanger; DE10049890B4 and JP2013130300A, disclosing respective heat transfer increasing barrier systems in respective plate exchangers.

Hence, the invention relates to a plate for a heat exchanger between a first medium and a second medium, the plate being associated with a main plane of extension and a main longitudinal direction and comprising a first heat transfer surface, extending substantially in parallel to said main plane and arranged to be in contact with the first medium, generally flowing along the first surface in a first flow direction; and a second heat transfer surface, extending substantially in parallel to said main plane and arranged to be in contact with the second medium, generally flowing along the second surface in a second flow direction; wherein the first heat transfer surface comprises a first medium inlet region, a first medium transfer region and a first medium outlet region, which first medium outlet region comprises a first medium outlet port; and the second heat transfer surface comprises a second medium inlet region, a second medium transfer region and a second medium outlet region, which second medium inlet region overlaps, in the main plane, with the first medium outlet region and comprises a second medium inlet port not overlapping, in the main plane, with the said first medium outlet port; which plate is characterised in that the first medium outlet region comprises at least one protruding ridge extending from a respective edge of the first heat transfer surface and along a direction which has at least a component which is perpendicular to said main longitudinal direction, and in that said one or more protruding ridges form a barrier system for the first medium and define a channel along which the first medium is forced to travel, as seen in said main plane, on its way from the first medium transfer region to the first medium outlet port, which channel runs first towards, then around and thereafter away from the second medium inlet port.

In the following, the invention will be described in detail, with reference to exemplifying embodiments of the invention and to the enclosed drawings, wherein.

Figure 1:
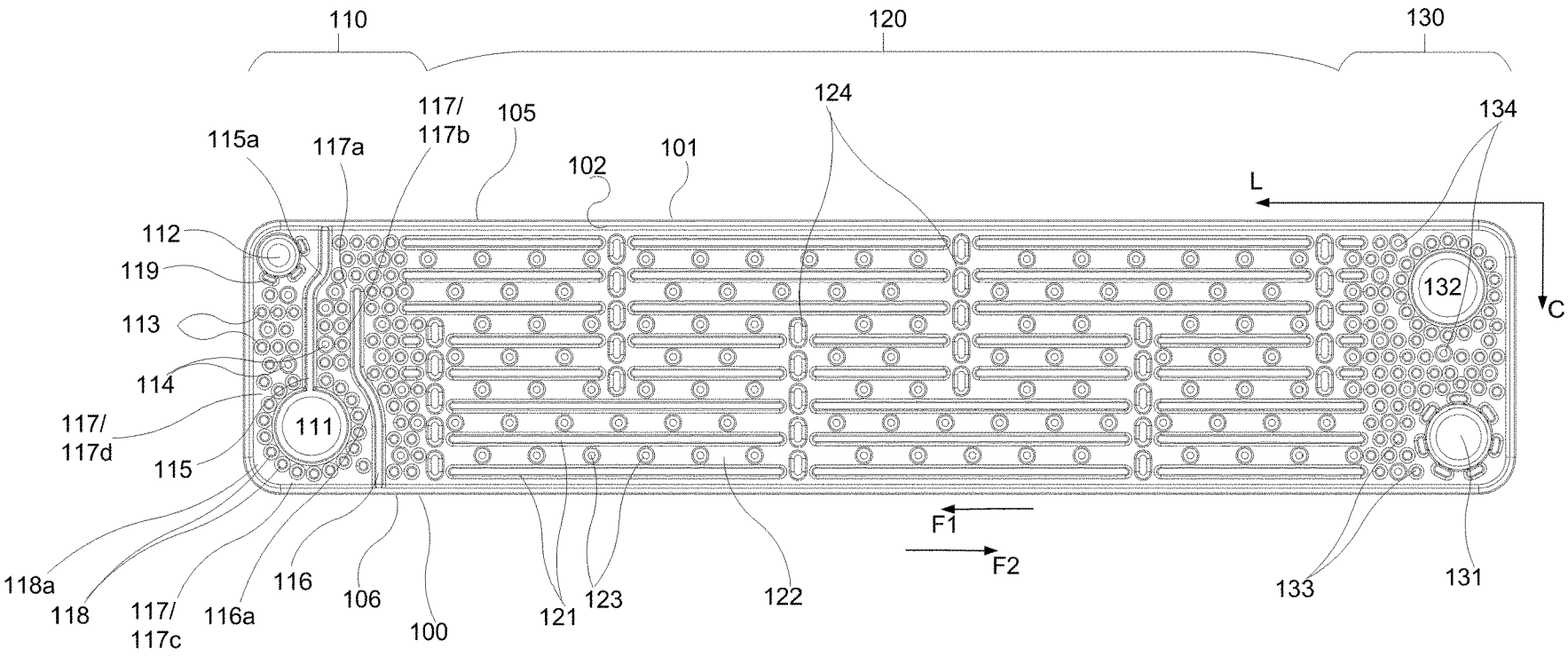
FIG. 1 is a top view of a heat exchanger plate according to a first exemplifying embodiment of the present invention.
Figure 2:
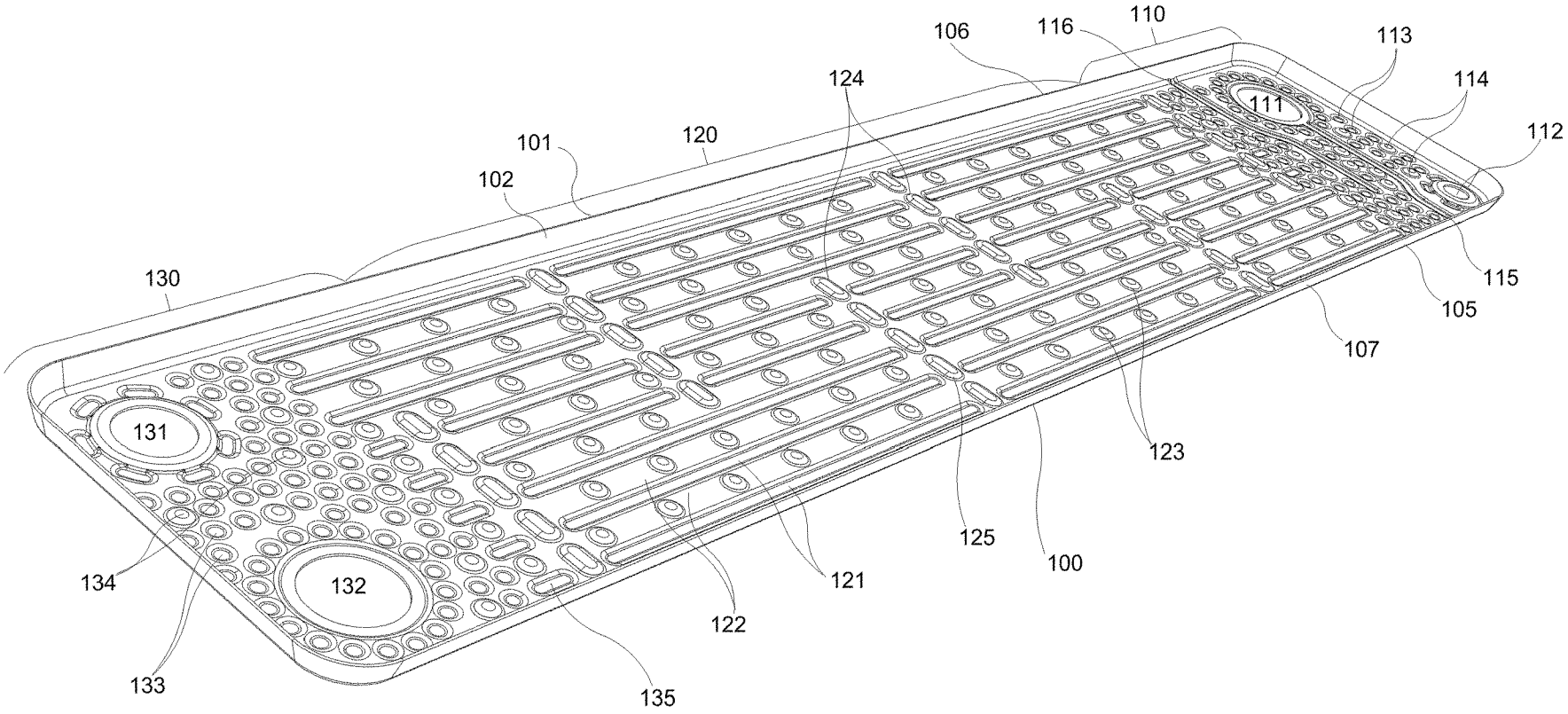
FIG. 2 is a perspective view of the heat exchanger plate shown in FIG. 1.
Figure 3:
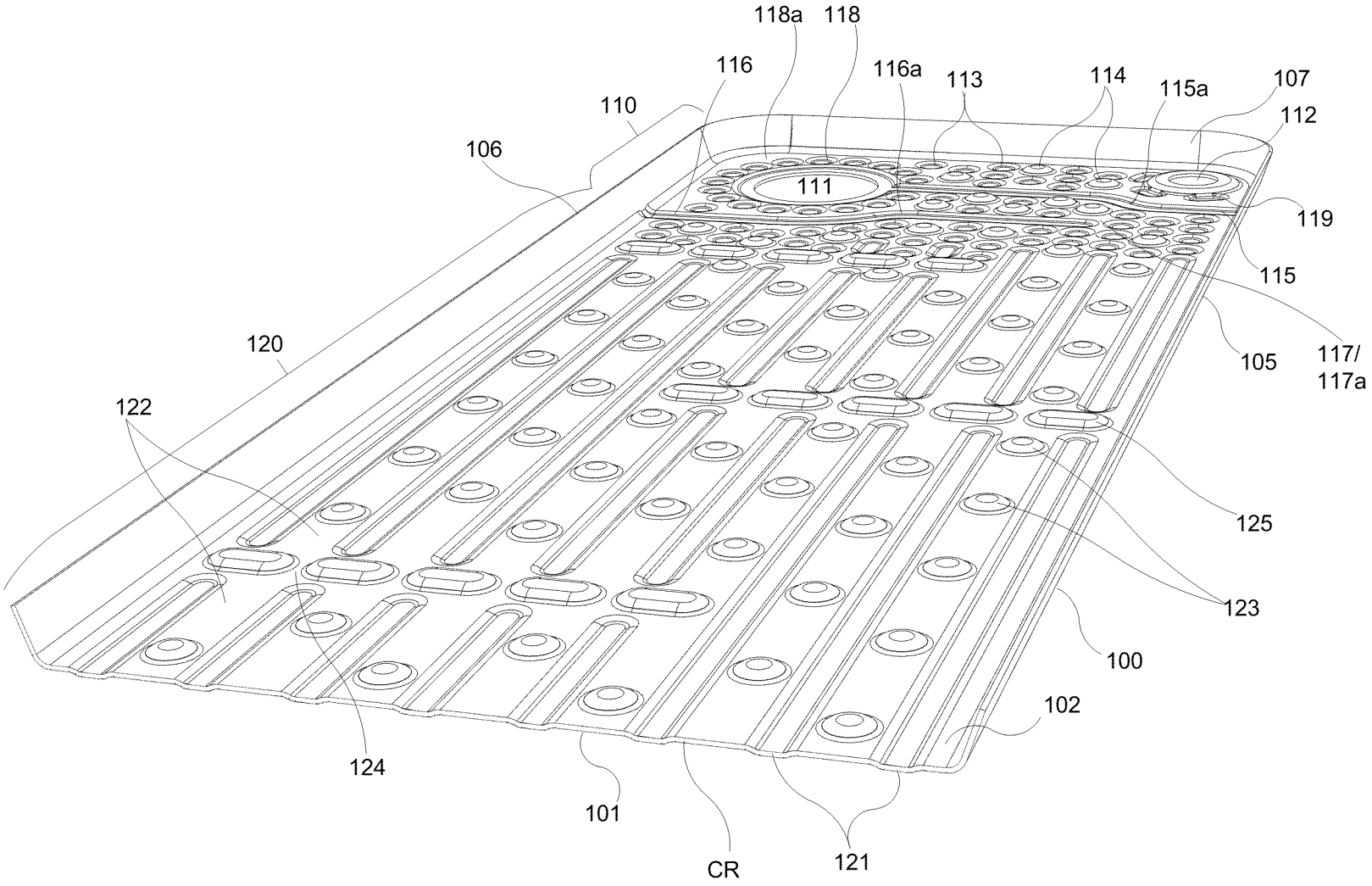
FIG. 3 is a partly removed perspective view of the heat exchanger plate shown in FIG. 1.
Figure 3A:
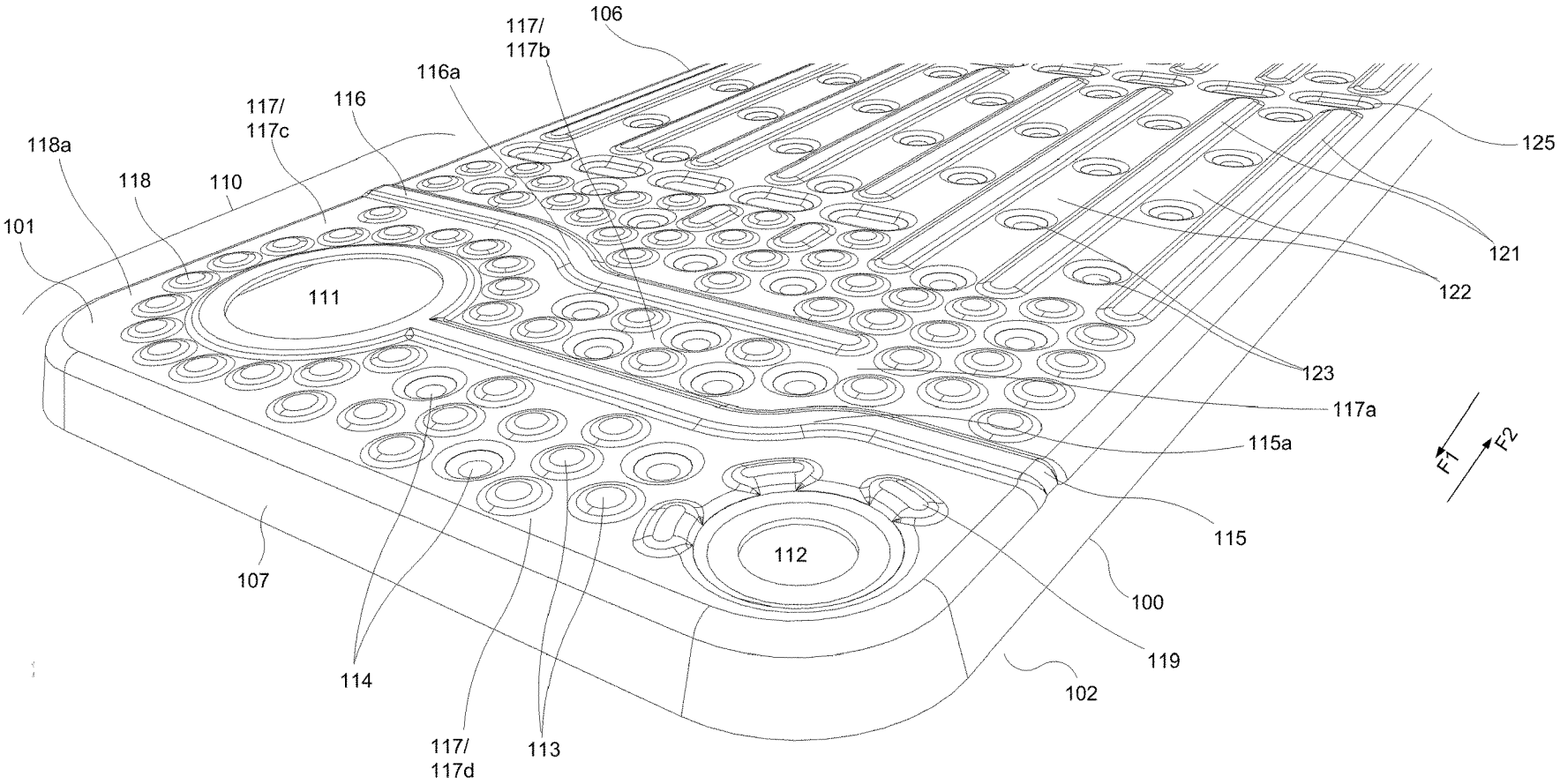
FIG. 3A is also a partly removed perspective view of the heat exchanger plate shown in FIG. 1.

All Figures share a common set of reference numerals, denoting same parts. Moreover, for the two main exemplifying heat exchanging plates 100, 200, as well as the plate 400, shown in the Figures, the respective two last digits in each reference numerals denote corresponding parts of these two plates, as applicable. In general in the figures, "CR" denotes a cross-sectional surface.

Hence, FIGS. 1-4 illustrate a plate 100 for a heat exchanger between a first medium and a second medium. The first and second media may each, independently of each other, be a liquid or a gas, and/or transition from one to the other as a result of a heat exchanging action taking place between said media using said plate 100 as a component part in a heat exchanger according to the invention.

Figure 4:
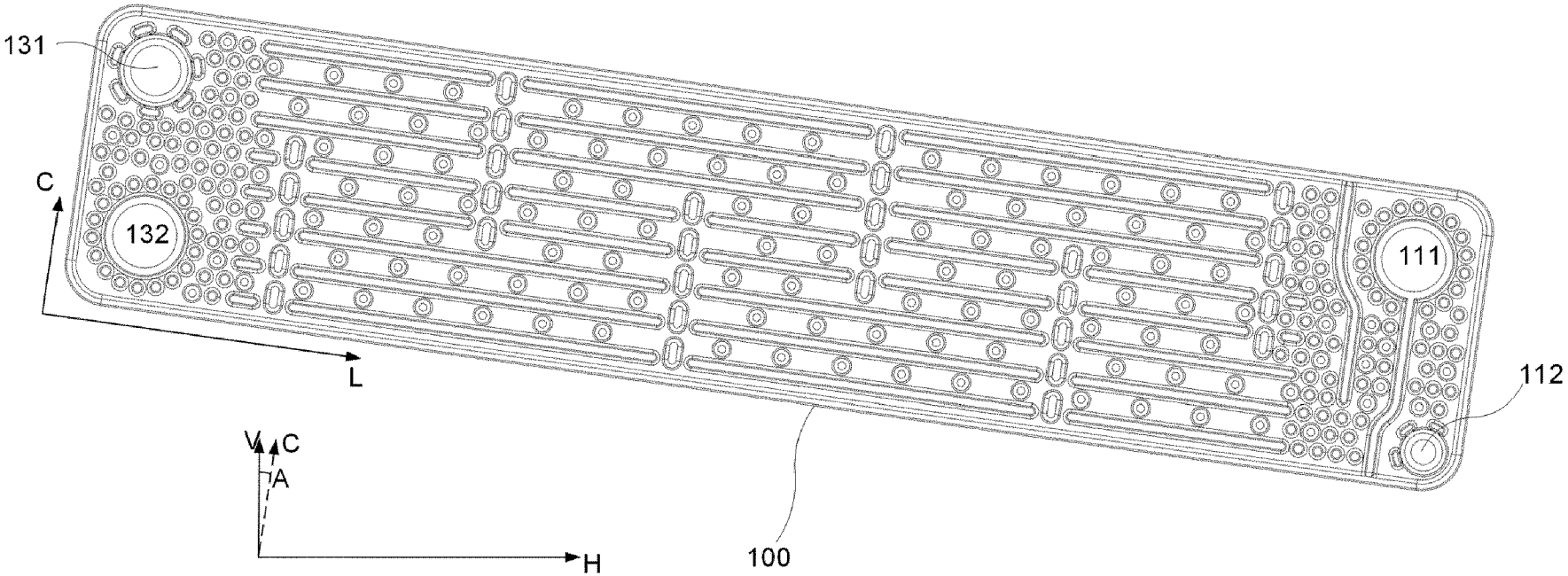
FIG. 4 is a top view of the heat exchanger plate shown in FIG. 1, shown in FIG. 4 in a preferred mounting orientation according to the present invention.
Figure 6:
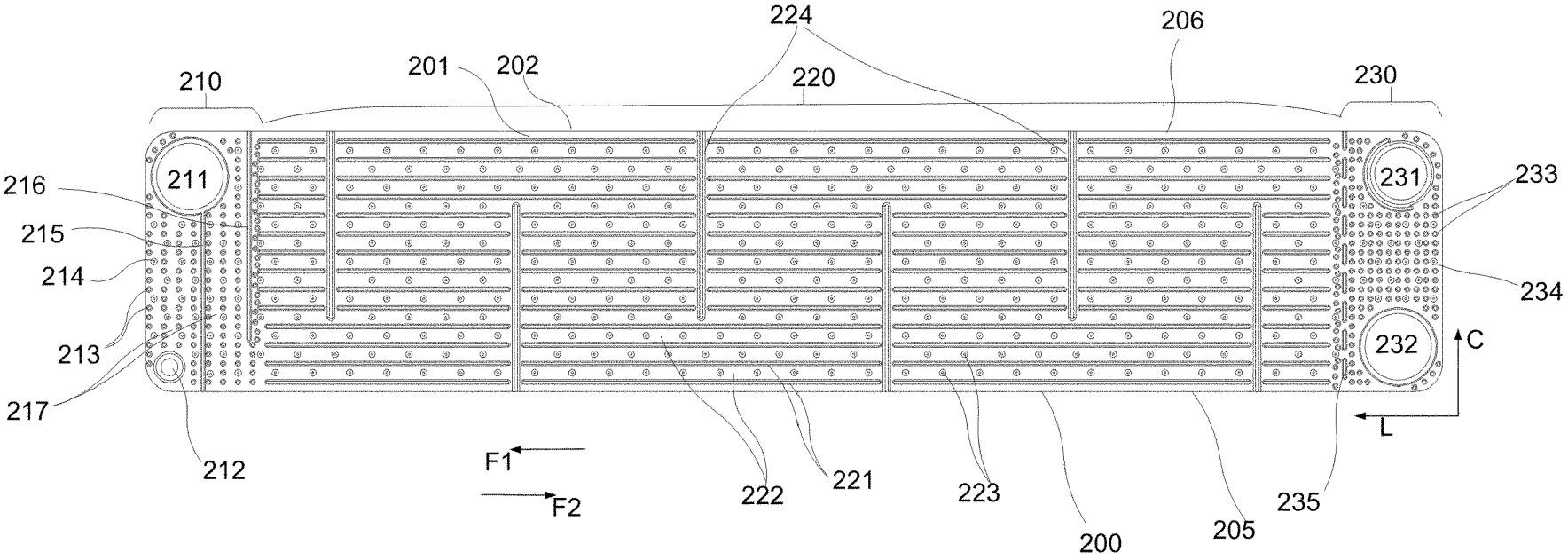
FIG. 6 is a top planar view of the heat exchanger plate shown in FIG. 5.

The plate 100, 200 is associated with a main plane of extension, which is not indicated in the Figures but which lies in the plane of the paper in FIGS. 1, 4 and 6. The plate 100, 200 is furthermore associated with a main longitudinal direction L and a cross direction C. The cross direction C is perpendicular to the main longitudinal direction L and parallel to the main plane.

The plate 100 comprises a first heat transfer surface 101, extending substantially in parallel to said main plane and arranged to be in contact with the first medium during heat exchanging, which first medium generally flows, during use of the plate 100 in said heat exchanger, along the first surface 101 in a first flow direction F1. The plate 100 furthermore comprises a second heat transfer surface 102, extending substantially in parallel to said main plane and arranged to be in contact with the second medium, generally flowing, during such use, along the second surface 102 in a second flow direction F2. Both flow directions F1 and F2 are preferably substantially parallel to the longitudinal direction L.

It is noted that the flow directions F1 and F2 illustrated in the figures are such that the plate 100 is for a counter-flow heat exchanger. This is the preferred configuration. It is also conceivable to use a parallel-flow heat exchanger with a subcooling region as the one described herein. In that case, a similar design as the ones illustrated in the figures can be used, but wherein the second medium inlet and outlet are switched, so that the second medium flows in the opposite direction as described herein.

The plate 100 comprises, in reverse order in the longitudinal direction L, a first region 110, a second region 120 and a third region 130. The first 110 and third 130 regions comprise media inlets and outlets, while the second region 120 is a transfer region across which the media are transported between regions 110, 130. Preferably, there are no media inlets or outlets along the transfer region 120, which preferably occupies at least half of the total length of the plate 100 in the longitudinal direction L.

The plate 100 furthermore comprises an inlet 131 for the first medium and an outlet 112 for the first medium, as well as an inlet 111 for the second medium and an outlet 132 for the second medium. These inlets 111, 131 and outlets 112, 132 may be in the form of through holes in the plate 100. In the Figures, the said through holes have circular shape. However, it is realized that any suitable shape can be used, such as quadratic shapes. Since the plates 100, 200 are preferably identical or substantially identical (apart from some being mirrored—see below regarding plates 100, 200 of first and second types), when the plates 100, 200 are stacked these through holes will align to form a tunnel with a cross-sectional shape being the same as the shape of the through holes in question. During use, when the plate 100 is mounted as one of a plurality of such plates 100 in a heat exchanger according to the invention, as described in further detail below, each of the inlets and outlets 131; 112; 111; 132 are connected to corresponding inlets/outlets of other plates in the same plate stack so as to form a general first medium inlet, first medium outlet, second medium inlet and second medium outlet port. Then, the inlet ports are arranged to distribute the first and second medium, respectively, to the inlets 131; 111 of each plate, and which outlet ports are arranged to convey the first and second medium, respectively, from the outlets 112; 132 and away from the heat exchanger.

Inlet 111 and outlet 112 are preferably completely arranged in said first region 110, while inlet 131 and outlet 132 preferably are completely arranged in the second region 130.

Along the flow direction F1, F2, the first and second medium, respectively, flow in channels formed by adjacent plates 100 in the same plate stack, between respective inlet 111, 131 and respective outlet 112, 132.

It is noted that the respective pairs 131, 112; 111, 132 of inlets are arranged so that both heat mediums flow in a crossing fashion in relation to the cross direction C, whereby each heat medium crosses over, on its way from inlet to outlet, from one cross direction C side 105, 106 to the other, and even so that the flow paths cross as seen in the main plane of the plate 100. Even if this is the preferred arrangement, it is realized that other arrangements are also possible, for instance by switching the locations of 131 and 132.

Figure 7:
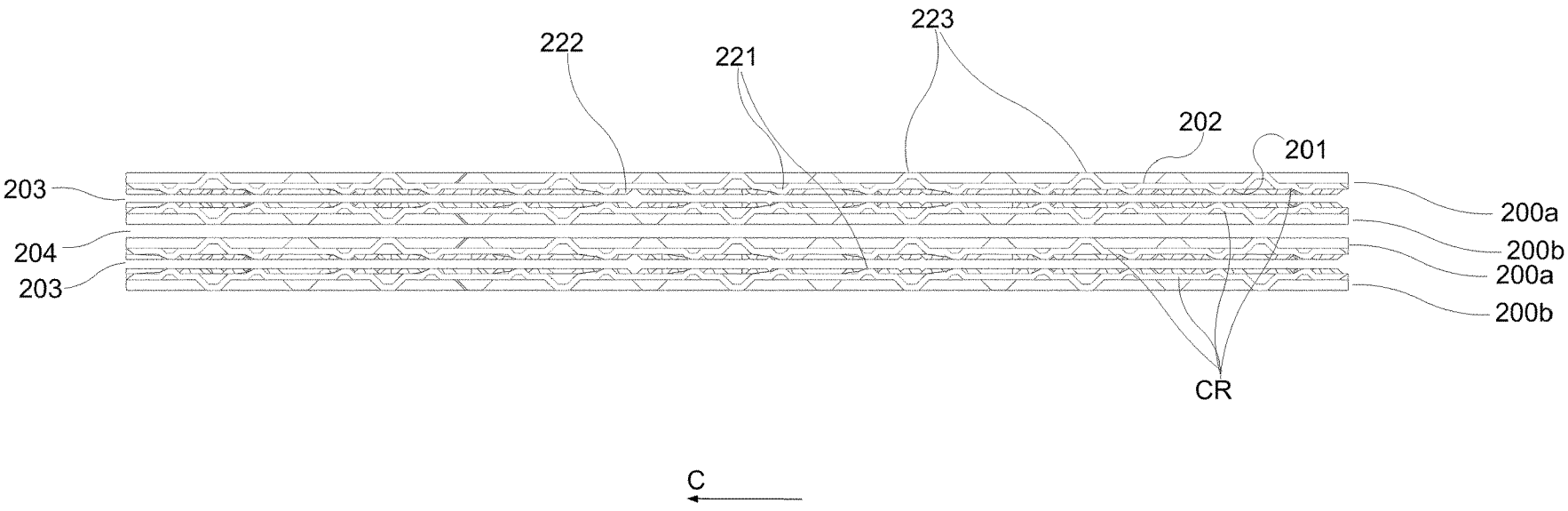
FIG. 7 is a planar side view of a cross-section face of the heat exchanger plate shown in FIG. 5, together with three additional corresponding heat exchanger plates schematically illustrating the orientation of said plates in a heat exchanger according to the invention.

More particularly, a heat exchanger according to the present invention comprises a plurality of plates 100 of two types—a first type and a second type. Plates 100 of both said first 100*a* and said second 100*b* type are as such plates of the type described herein, where the plates of said second type have a shape which is substantially mirrored, in relation to the said main plane of the plate 100 in question, to the shape of the plates of said first type. All plates of the first type may be identical within the group of first type plates, while all plates of the second type may be identical within that group. Furthermore, the plates are arranged in a stack on top of each other (stacked in a direction perpendicular to the main plane of the plates, which main planes are arranged to be parallel), with plates of said first and second type arranged alternatingly. Since the plates of first and second type are mirrored, corresponding ones of dimples and ridges arranged on adjacent plates come into and stay in direct contact with each other, so that corresponding first 101 and/or second surfaces 102 of adjacent plates directly abut each other and so that flow channels 103, 104 for said first and second media are formed between said surfaces 101, 102. This is illustrated in FIG. 7, using the plate 200 and illustrated with a small distance between each pair of adjacent plates for increased clarity. In a mounted state, however, there is no distance—the plates 200 are arranged so that the dimples 223 and ridges 221 of neighbouring plates 200 come into direct contact with each other.

It is realized that the plate 100 may preferably be stacked in a corresponding manner so as to constitute component parts of a corresponding heat exchanger according to the invention. As is clear from FIGS. 2 and 3, the plate 100 (in contrast to plate 200) has a bent edge 107 running around the periphery of the plate 100. The edge 107 is bent in relation to the main plane of the plate 100, and has the purpose of simplifying the process of joining the plates 100 together to form said stack of plates 100. If such a bent edge 107 is present, the edge 107 is not mirrored between plates of first and second types, as opposed to the ridges and dimples of the plate 100.

Herein, by "substantially mirrored" is meant that all, or at least 95%, of the dimples and ridges described herein are present and coinciding between neighbouring plates. Preferably, mirrored plates are identical but mirrored, apart from a possible bent side edge of the above mentioned type.

In such a heat exchanger, suitably designed end plates may be used, sealing the last plate 100, 200 in the stack on either stack end and forming a sealed heat exchanger the only inlets/outlets of which are the above described inlet and outlet ports.

Hence, each plate 100, 200 transfers heat between the said first and second media, as a result of the first medium being transported in a channel 203 (see FIG. 7) having the first surface 101, 201 as a limiting side wall while the second medium is transported in a channel 104, 204 having the second surface 102, 202 as a limiting side wall, which channels 103, 104; 203, 204 are only separated by said plate 100, 200. More particularly, the first medium flows in a channel defined by opposing respective surfaces 101, 201 of adjacent plates 200*a*, 200*b*, while the second medium with which the first medium is heat exchanged flows in a corresponding channel defined by opposing respective surfaces 102, 202 of adjacent plates 200*b*, 200*a*. See furthermore FIGS. 8 and 9.

According to a preferred embodiment, the first surface 101 comprises protruding ridges 121, defining at least two parallel and open-ended channels 122 extending in the first flow direction F1. Furthermore, the second surface 102 preferably comprises a plurality of protruding dimples 123 arranged in said channels 122 between neighbouring respective pairs of said ridges 121.

Herein, a "ridge" refers to an elongated protruding geometric feature of the surface 101 in question on which the ridge is arranged. Preferably, such a ridge 121 in the first surface 101 is associated with a corresponding elongated indentation or recess in the opposite surface 102.

Similarly, a "dimple" refers herein to a point-like protruding geometric feature of the surface 102 in question on which the dimple in question is arranged. Preferably, such a dimple is associated with a corresponding point-like indentation or recess in the opposite surface 101. In the Figures, dimples are shown with a generally circular shape. It is, however, realized that any suitable shape, such as quadratic or octagonal, may be used, depending on application. Hence, the word "point-like" is intended to mean "with a shape, in the main plane of the plate in question, which is generally centred about a particular point rather than elongated".

Both ridges and dimples are preferably arranged with a planar top surface, arranged to abut a corresponding planar top surface of a corresponding respective ridge or dimple, of an adjacently arranged, mirrored heat exchanger plate.

The plate 100 is preferably manufactured from sheet metal, with a material thickness which preferably is substantially equal across the whole plate 100 main plane, and in particular across ridges 115, 116, 121, 125 and dimples 118, 119, 123, 113, 114, 133, 134, 135 (see below). Advantageously, the plate 100 is manufactured from a piece of sheet metal which is stamped into the desired shape.

Such a heat exchanger plate 100, and in particular a heat exchanging plate 100 with such a pattern of channel-forming ridges 121 and dimples 123 arranged in the formed channels 122, has been found to provide very good mechanical stability when used as a component part in a heat exchanger of the type described herein, while still being able to very efficiently transfer heat between said first and second media, across a wide range of applications. It is, however, noted that different patterns of dimples and/or ridges than the ones illustrated in the Figures may be used, in particular in the transfer region 120, 220, while still reaping the benefits of the cooling part with the channel 117, 217 (see below) as claimed.

Using such a plate 100 also makes it possible for the ridges and dimples to be designed with very small height (see below), so as to achieve a heat exchanger using only a very small volume of first and/or second medium. In particular, the ridge height can be made very small, whereby the amount of first medium can be reduced. Such miniaturizing can be made without jeopardizing efficiency and pressure drop requirements.

Figure 5:
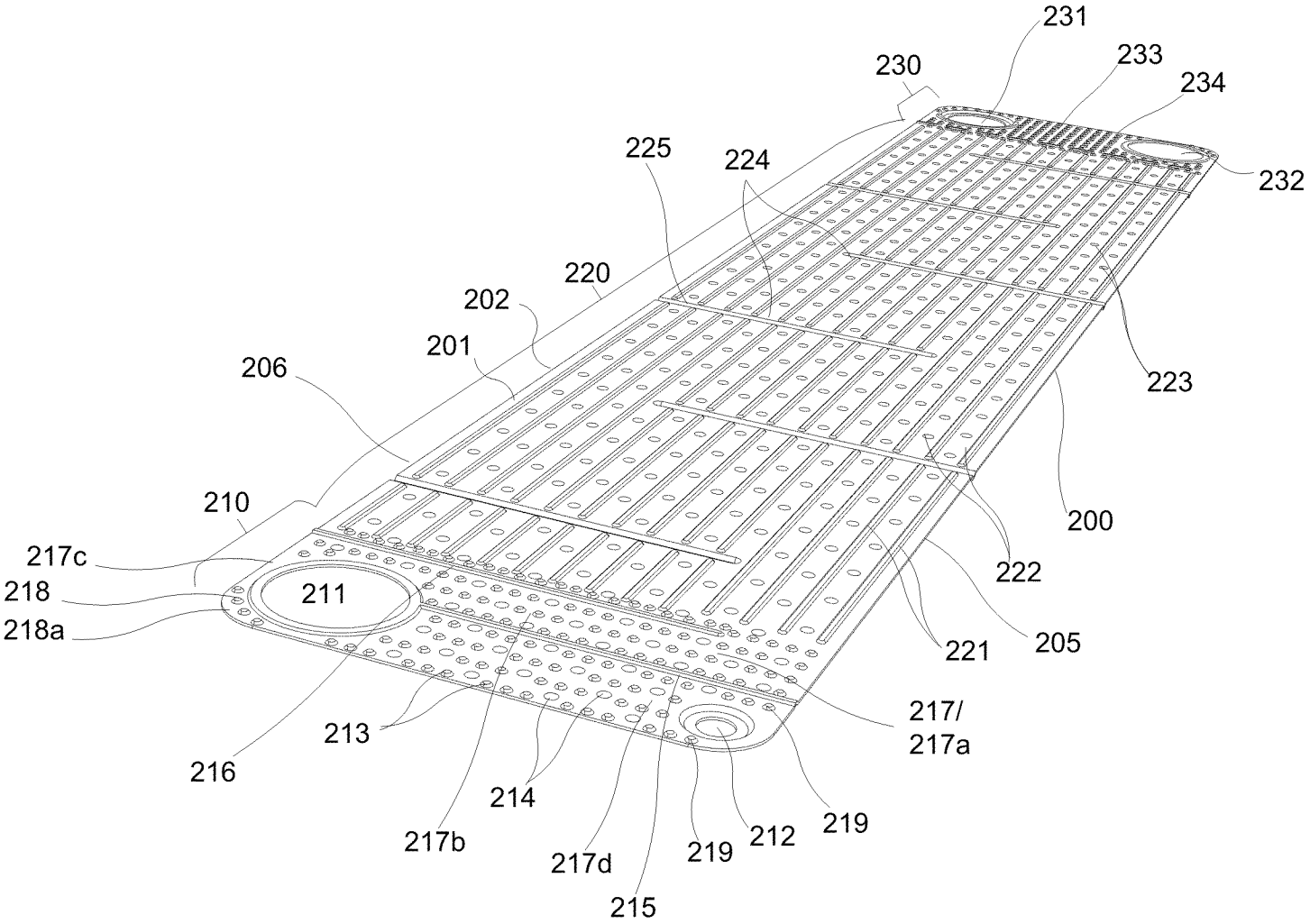
FIG. 5 is a perspective view of a heat exchanger plate according to a second exemplifying embodiment of the present invention.

FIGS. 5 and 6 illustrate a second exemplifying heat exchanger plate 200, with corresponding first 201 and second 202 surfaces; regions 210, 220, 230; inlets 211, 231; outlets 212, 232; ridges 221, channels 222 and dimples 223. This second heat exchanger plate 200 offers similar advantages as the first plate 100, as described above and further below.

As illustrated in the Figures, said protruding ridges 121, 221 preferably define at least three, preferably at least five (in the exemplifying plate 100, there are seven channels 122, while there are thirteen channels 222 in the exemplifying plate 200), parallel and open-ended channels 122 extending in the first flow direction F1. The inventors have found that, for small heat exchangers, substantial advantages can be achieved already with two, in some cases at least three, such channels, while, for larger heat exchangers, more channels will provide better distribution of the first medium.

It is preferred that the channels 122 extend along substantially the whole second region 120 of the plate 100, along the longitudinal direction L. In particular, at least three of the channels 122 preferably each extend along at least 50%, preferably at least 60%, of the entire length, in the longitudinal direction L, of the plate 100.

It is preferred that the dimples 123 are arranged along at least three of the channels 122, preferably along all channels 122. Preferably, the dimples 123 are distributed along substantially the entire length of each individual channel 122, preferably substantially equidistantly. Preferably, each channel having dimples 123 is arranged with at least three, preferably at least five, preferably at least ten, such dimples 123 along its respective length. The dimples 123 of adjacent parallel channels 122 are preferably arranged so that they are displaced somewhat in the longitudinal direction L in relation to each other, as disclosed in the Figures.

According to one preferred embodiment, the channels 122 are arranged with a shape permitting the channels 122, 103 (wherein channel 103 is formed by two opposed and mirrored open channel parts 122 as described above) to be completely emptied of the first medium, when the first medium is in liquid form and when the plate 100 is arranged in a mounted state for use, which mounted state is illustrated in FIG. 4. In this mounted state, the main plane of the plate 100 is substantially vertically oriented and with the cross direction C arranged at an angle A to the vertical V, and the longitudinal direction L inclined with the same angle A in relation to the horizontal direction H. The angle A is preferably between 5° and 40°. In order to be completely emptied of said first medium, the curvature of at least one respective side wall (in FIG. 5, the side wall facing upwards in the vertical direction) of each of the ridges 121 lacks local minima in the main plane and said cross direction C. Since the side wall of the ridge 121 forms the floor of the channel 122 when the plate 100 is mounted in the orientation illustrated in FIG. 5, the absence of such local minima guarantees that no liquid first medium will become trapped in such local minima during operation, and as a result the channels 122 can be completely emptied. Of course, at the longitudinal end of each ridge 121 the curvature of the ridge side wall in question bends downwards, but this does not count as a local minimum in the sense intended here.

That the channels 122 can be emptied completely when the plate 100 is in the slightly slanted mounted orientation as illustrated in FIG. 4 achieves good efficiency for the preferred condensing heat exchanger application, with a cooling or subcooling function described in fuller detail below, while still achieving the above-described advantages in terms of efficiency and robustness. Also, problems with overheating in areas where condensate is caught are avoided.

Preferably, at least one, preferably at least two neighbouring ones, of said ridges 121 is or are interrupted in at least one location along said first flow direction F1, defining a respective mixing zone 124 for the first medium flowing through corresponding neighbouring ones of said channels 122. Further preferably, the said mixing zone 124 interconnects all, or at least a majority, of said parallel channels 122 being present in said at least one location along the first flow direction F1. This provides good heat transfer efficiency while maintaining structural robustness of the heat exchanger. By distributing the first medium evenly across the cross-direction, plate 100 tensions are also kept to a minimum since the heat transfer process will be even. According to an alternative embodiment, the mixing zones 124 do not interconnect all of said parallel channels 122 being present in said at least one location along the first flow direction F1.

It is preferred that several such mixing zones 124 are arranged at different locations along the longitudinal direction L, such as equidistantly arranged. It is also preferred, as illustrated in the Figures, that neighbouring mixing zones 124 are displaced in relation to each other in the cross direction C, so that at least one channel 122 extends uninterrupted past at least one mixing zone.

The mixing zones may be arranged as simple interruptions in the corresponding ridges, allowing the first medium to mix between channels at the mixing zone in question. However, as illustrated in the Figures, it is alternatively preferred that the second surface comprises at least one protruding barrier structure, preferably a ridge 125, 225 extending in a direction substantially perpendicular to the second flow direction F2 and arranged in said mixing zone 124, 224. As shown in FIGS. 1-4, the ridge 125 may define a penetrable barrier for the second medium. As illustrated in FIG. 5, the ridge 225 may alternatively comprise a connected barrier, not being penetrable to the second medium, but extending across the whole cross-direction C so as not to allow the first medium past but forcing it to move along a curvilinear path.

As mentioned above, the plate 100 preferably comprises, in reverse order along the main longitudinal direction L, regions 110, 120 and 130. The region 130 may comprise, on the first surface 101, a first medium inlet region. The region 120 may comprise, on the first surface 101, a first medium transfer region. The region 110 may comprise, on the first surface 101, a first medium outlet region.

In a preferred embodiment, the first surface 101 comprises at least three mixing zones 124 of the above described type, arranged at different locations in the first flow direction F1, and wherein the said mixing zones 124 are more densely or closer arranged, as seen in the first flow direction F1, closer to the first medium inlet region than further from the first medium inlet region. Note that such varying mixing region 124 density is not illustrated in the Figures.

According to the invention, the first heat transfer surface 101, 201 comprises said first medium inlet region, said first medium transfer region and said first medium outlet region. Moreover, the first medium outlet region comprises the first medium outlet port 112, 212.

Further according to the invention, the second heat transfer surface 102, 202 comprises a second medium inlet region, a second medium transfer region and a second medium outlet region, and the second medium inlet region overlaps, in the main plane, with the said first medium outlet region. Moreover, the second medium inlet region comprises the second medium inlet port 111, 211, which in turn does not overlap, in the main plane, with the said first medium outlet port 112, 212.

Preferably, the second medium outlet region overlaps with the first medium inlet region. This then defines a plate for use in a counter-flow heat exchanger. In general, the plate 100, 200 preferably comprises, on the second surface 102, 202, a second medium transfer region, overlapping with the first medium transfer region.

In particular, it is preferred that the said first medium inlet region comprises the first medium inlet 131, 231. Then, it is preferred, in particular in case the heat exchanger is a condenser type heat exchanger, that the first medium inlet 131, 231 has a larger, preferably at least two times the size, cross-section, in the main plane, than the first medium outlet 112, 212. This cross-section size is hence the hole size in the preferred case in which the inlet 131, 231 and the outlet 112, 212 are through holes. Such configuration caters for an efficient construction when using a first medium which is condensed from gas phase to liquid phase as a result of the heat exchange.

Furthermore, it is preferred that the first medium inlet region comprises a pattern of protrusions 135, 235, preferably short ridges extending with a component along the first medium flow direction F1 (FIGS. 1-4) or along the cross direction C (FIGS. 5 and 6), arranged to distribute the first medium to respective inlets of at least two of said parallel channels 122, 222.

Apart from the above described ridges 121, 221 and dimples 123, 223 arranged in the channels 122, 222, at least one of the first 101 and second 102 surfaces, preferably both, comprises a respective plurality of additional protruding dimples. In the Figures, these additional dimples are illustrated as first surface 101, 201 dimples 113, 213 in the first region 110, 210; first surface 101, 201 dimples 133, 233 in the third region 130, 230; second surface 102, 202 dimples 114, 214 in the first region 110, 210; and second surface 102, 202 dimples 134, 234 in the third region 130, 230. It is preferred that the plate 100, 200 comprises all four or these types of dimples 113, 133, 114, 134; 213, 233, 214, 234.

These dimples share the joint purpose of distributing the respective medium across the plate 100; 200 respective surface 101, 102; 201, 202, increasing heat transfer efficiency; as well as providing mechanical stability to the heat exchanger.

In particular, it is preferred that the first surface 101, 201 comprises more, preferably at least twice as many, preferably at least three times as many, of said additional dimples 113, 133; 213, 233 as compared to the number of second surface 102, 202 additional dimples 114, 134; 214, 234. This has proven to achieve very efficient heat transfer, in particular in the case of a condenser-type heat exchanger, without jeopardizing its mechanical stability. Also, this achieves the possibility of handling larger medium pressure resistance to the heat exchanger.

As is clear from FIG. 7, the first medium channels 203 are lower (in a direction perpendicular to the main plane of each plate 200) than the second medium channels 204. This is particularly preferred in case of a condenser-type heat exchanger, in which the first medium is condensed as a result of the heat exchanging.

In particular, it is preferred that the respective height, perpendicular to the said main plane, of the above described dimples and ridges define a first flow height for the first medium, in said first medium channel 203, and a second flow height for the second medium, in said second channel 204. Then, it is preferred that the second flow height is at least 2 times, preferably at least 5 times, larger than the first flow height. The corresponding is true regarding the exemplifying plate illustrated in FIGS. 1-4.

In order for all corresponding dimples and ridges to abut between adjacent, mirrored plates, it is realized that all dimples and ridges on either surface 101, 102; 201, 202 are preferably of the same height as measured from the said main plane.

In a particularly preferred embodiment, the first flow height, of the first medium channel 203, is at the most 2 mm, preferably at the most 1 mm, preferably at least 0.5 mm. This means that the height, including any additional material used to join the plates together, such as brazing material between abutting dimples and ridges, of individual dimples and ridges is at the most 1 mm, preferably 0.4 mm, preferably at least 0.2 mm. In the preferred case of a brazed together structure (see below), it is preferred that the brazing material used, preferably in the form of a foil, such as a copper foil, before heating, is 0.01 mm to 0.08 mm thick.

As regards the parallel channels 122, 222, they are preferably between 5 and 20 mm, preferably between 8 and 15 mm, wide, in the cross direction C.

In the following, the first medium outlet region will be described in closer detail, specifically with respect to a structure providing efficient cooling of the first medium before exiting through the first medium outlet port 112, 212. In particular, such a structure is useful as a subcooling structure, efficiently cooling a condensed first medium below a condensation temperature of the first medium before exiting through the first medium outlet port 112, 212. This is particularly useful in a counter-flow type heat exchanger as described above and below. These advantages can be achieved without risking the mechanical stability of the heat exchanger, even at relatively large media pressures, and requires only limited amounts of the first medium.

Hence, according to the invention the first medium outlet region comprises at least one, preferably at least two, protruding ridges 115, 116; 215, 216 extending from a respective edge, such as a side edge 105, 106, 205, 206, of the first heat transfer surface 101; 201 and along a direction which has at least a component which is perpendicular to said main longitudinal direction L. Furthermore, said one or more protruding ridges 115, 116; 215, 216 form a barrier system for the first medium and define a channel 117, 217 along which the first medium is forced to travel, as seen in said main plane, on its way from the first medium transfer region to the first medium outlet port 112, 212. As seen in the Figures, the channel 117, 217 runs first towards, then around and thereafter away from the second medium inlet port 111, 211. The channel 117, 217 is associated with a channel inlet 117*a*, 217*a*.

This provides a very powerful and efficient heat transfer between the first and second media in the first medium outlet region, in particular such a heat transfer from the first medium to the second medium in case the first medium is cooled. In case of a condenser type heat exchanger, it is preferred that the heat exchanger is dimensioned so that the first medium is condensed, preferably fully condensed, already upon entry into the channel 117, 217, whereupon the heat transfer from the condensed first medium to the second medium entering via the second medium inlet port 111, 211 becomes very efficient.

According to a preferred embodiment, the channel 117, 217 has a flow cross-section which is at least 3 times, preferably at least 5 times, smaller than a total flow cross-section for the first medium immediately upstream of the channel 117, 217, so that, in case the first medium is in the same phase before and after the entering into the channel 117, 217, the first medium flow velocity is higher when passing through the channel 117, 217 as compared to immediately upstream of the channel 117, 217. However, it is preferred that the plate 100, 200 is dimensioned so that a first medium entering through the first medium inlet 131, 231 in gas phase traverses at least half of the first medium transfer region, preferably substantially the whole first medium transfer region, before it is fully condensed to liquid form. In particular, the condensation preferably occurs in connection to, and/or before entering, the channel 117, 217 entry, in such a way that the first medium, in liquid phase, still travels at lower flow velocity through the relatively narrower channel 117, 217 than the same first medium, in gaseous phase, travelling through the relatively broader first medium transfer region. Dimensioning a plate 100, 200 this way, in relation to particular selected first and second medium types and inlet temperatures, will yield a very efficient subcooling of the first medium. Said dimensioning may incur design choices regarding plate 100, 200 length and width, dimple and ridge arrangement, channel 203, 204 height, and so on.

Herein, "upstream" means upstream with respect to the first medium flow direction F1. As seen in FIGS. 1-4, for instance, the total flow cross-section immediately upstream of the channel 117 is substantially the whole cross-direction C width of the plate 100, while the total flow cross-section for the first medium in the channel 117 is, for instance, the longitudinal-direction L distance between the ridges 115, 116; the cross-direction C distance between the second medium inlet port 111 and the plate 100 edge 106; and the longitudinal-direction L distance between the ridge 115 and the plate 100 short-end, depending on which part of the channel 117 that is considered. The corresponding is valid for plate 200.

More particularly, it is preferred that the channel 117, 217, along a majority of its length, preferably along its entire length, is between 5 and 30 mm, preferably between 8 and 20 mm, wide.

In the preferred examples illustrated in the Figures, the plate 100, 200 comprises a first side edge 105, 205 and a second, opposite, side edge 106, 206, preferably long edges of the elongated plate 100, 200. The side edges 105, 106, 205, 206 are hence arranged at a distance from each other in the cross direction C.

The side edges 105, 106, 205, 206 are preferably disposed so that the first medium outlet port 112, 212 is arranged closer to the first side edge 105, 205 than the second medium inlet port 111, 211.

The said at least one protruding ridges preferably comprises a distal ridge 115, 215, running from the first side edge 105, 205 up to the second medium inlet port 111, 211. Furthermore, the said at least one protruding ridges preferably comprise a proximal ridge 116, 216, running from the second side edge 106, 206 towards but not up to the first side edge 105, 205. Hence, the proximal ridge 116, 216 preferably has a blind end, which is preferably not the case for the distal ridge 115, 215, ending in and preferably forming part of a ridge structure formed around and completely surrounding inlet 112, 212. In general, it is preferred that the proximal ridge 116, 216 is arranged closer to the first medium transfer region than the distal ridge 115, 215, and that the distal ridge 115, 215 is arranged between the first medium outlet port 112, 212 and the first medium transfer region.

Figure 10:
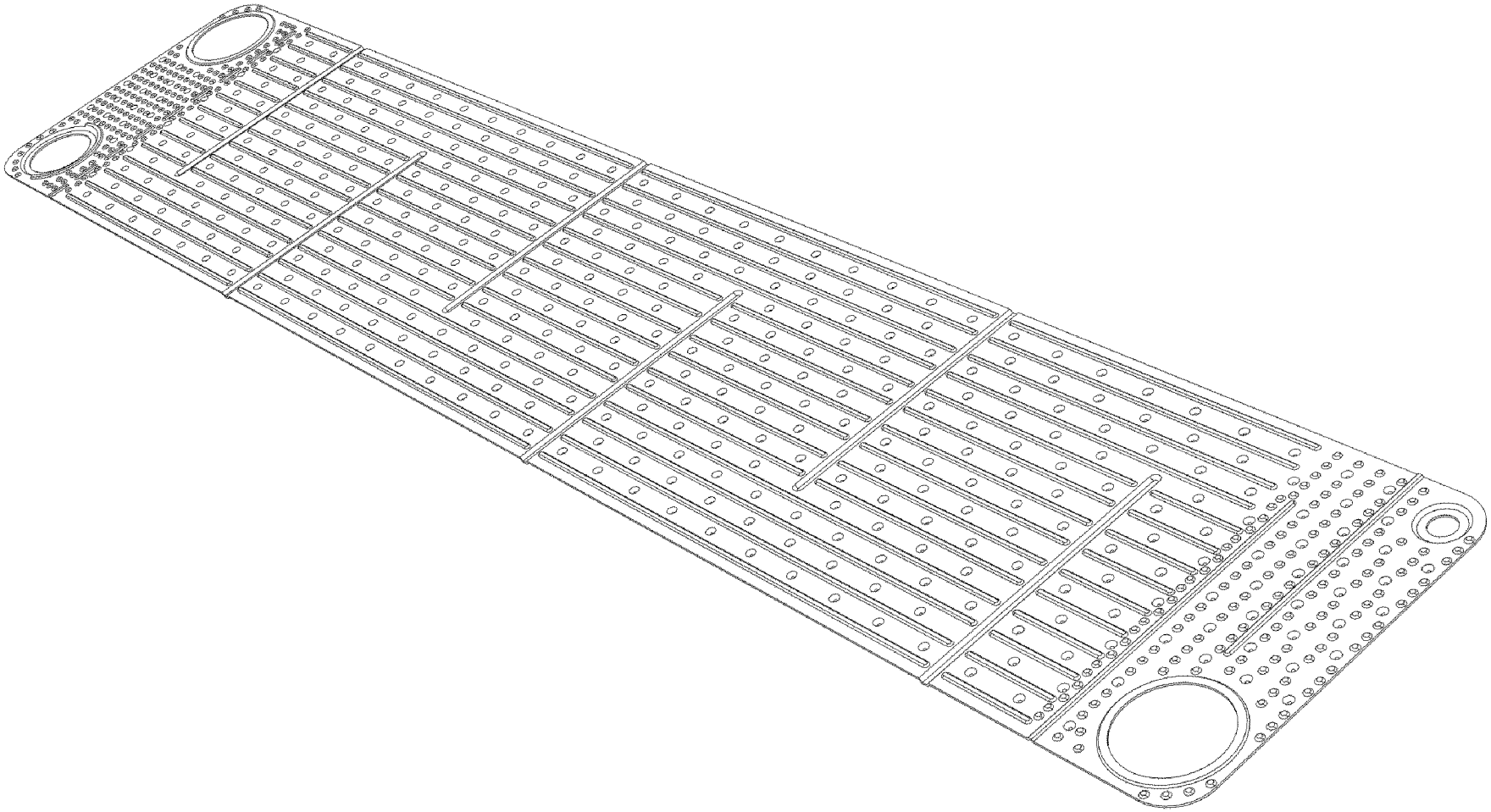
FIG. 10 is a perspective view of a heat exchanger not according to the invention.

In contrast thereto, FIG. 10 illustrates a heat plate not according to the present invention. Since the ridge in FIG. 10 corresponding to the proximal ridge 116, 216 does not extend all the way up to the port corresponding to the second medium inlet 111, 211, the first medium in FIG. 10 is not forced to travel around the second medium inlet. In particular, all of the first medium flowing from the first medium transfer region up to and out from the first medium outlet is not forced to travel around the second medium inlet.

As used herein in this context, that the first medium is "forced to travel around the second medium inlet" is intended to mean that all of the first medium travelling from the first medium transfer region up to and out from the first medium outlet is forced to travel around the second medium inlet, as opposed to only part of said first medium travelling around the second medium inlet.

Figure 11:
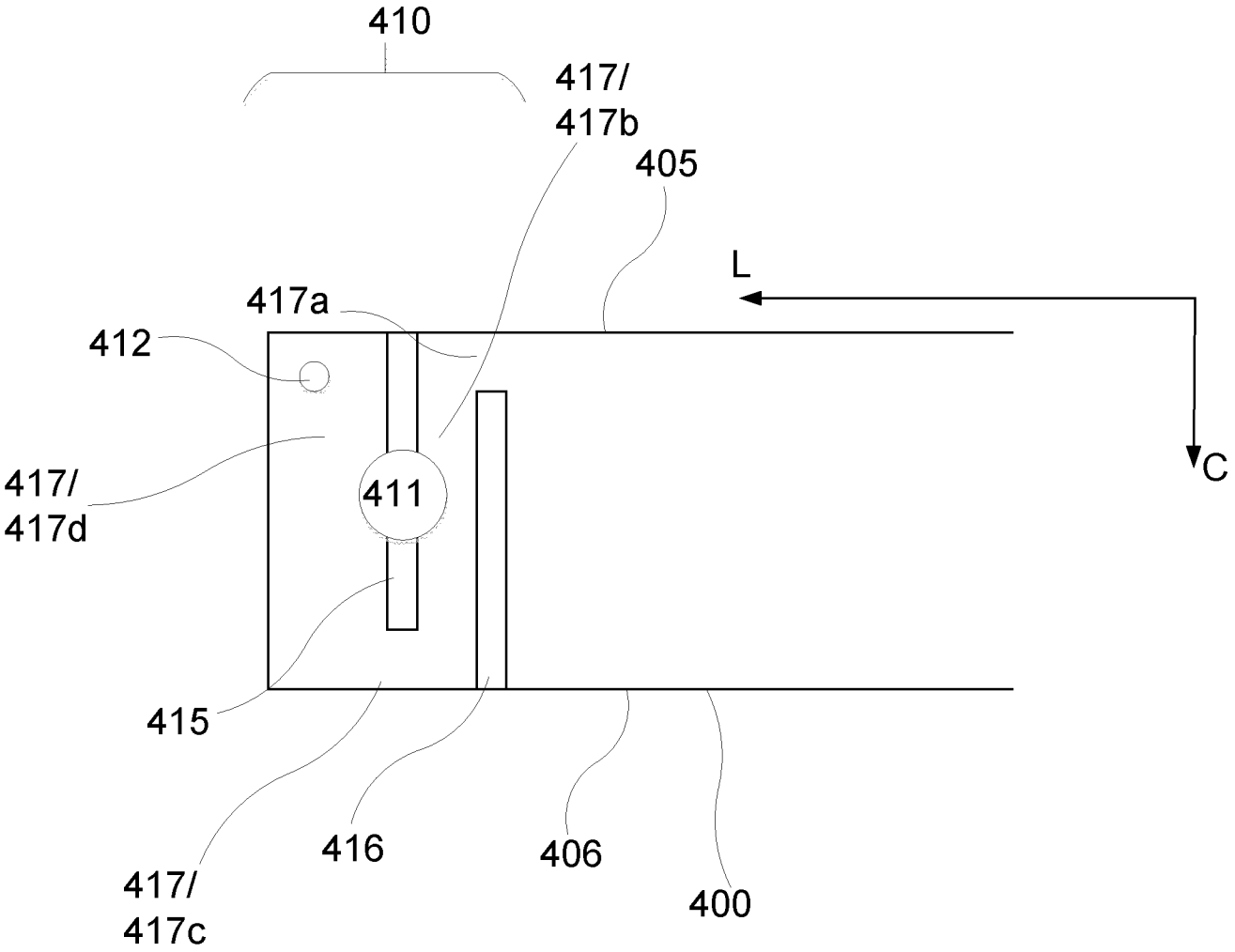
FIG. 11 is a simplified detail view of a heat exchanger plate according to a third exemplifying embodiment of the present invention.

FIG. 11 shows the respective first region 410 of a heat exchanger plate 400 according to the invention. The plate 400 comprises a first medium outlet 412 and a second medium inlet 411; a distal barrier 415 and a proximal barrier 416; a first side 405 and a second side 406; and a channel 417, comprising an inlet 417*a*, a first upstream portion 417*b*, an intermediate portion 417*c* and a second downstream portion 417*d*.

It is noted that the distal barrier 415 extends past the second medium inlet 411, but that the channel 417 still passes around the second medium inlet 411, via intermediate portion 417*c*. For instance, the proximal barrier 416 extends past the second medium inlet 411 in the cross direction C, which forces the first medium to pass the second medium inlet 411 both in the upstream portion 417*b* and the downstream portion 417*d*.

It is further noted that the channel 117, 217, 417 could also, for instance, be divided into a number of parallel sub-channels, all going around the second medium outlet. This would also mean that the channel in question, as a whole, passes around the second medium inlet.

In particular, and as shown in FIGS. 1-4, the distal ridge 115 comprises a curved part 115*a*, and is hence curved along at least one portion of the length of the channel 117, so as to generally follow the contour of the first medium outlet port 112. Herein, the expression "generally follow the countour of a port" means that the ridge in question has a curvature which at least roughly corresponds to the peripheral geometry of the port in question, but running at a distance, such as equidistantly, from and along a part of the port in question. Preferably, the curvature corresponds to the port geometry along at least 10 angular degrees with respect to the centre of the port in question.

Similarly, it is preferred that the proximal ridge 116 comprises a curved part 116*a*, and is hence curved along at least one portion of the length of the channel 117, so as to generally follow the contour of the second medium inlet port 111, with the corresponding meaning as for the curved part 115*a* in relation to the first medium outlet port 111.

Such a curved part 115*a* and/or 116*a*, and preferably a combination of both, achieves a very compact channel 117 geometry, providing high efficiency heat transfer in the region 110 while allowing a larger surface for the said transfer regions.

According to an alternative embodiment, shown in FIGS. 5 and 6, at least one, preferably both, of the distant 215 and proximal 216 ridges are straight. This makes for a simpler plate 200 design.

As described above, in preferred embodiments both the first and second heat transfer surfaces 101, 201 comprise respective dimples 113, 114, 123, 133, 134, 213, 214, 223, 233, 234. Preferably, such dimples are also present in the first region 110, 210, preferably comprising both first heat transfer surface 101, 201 dimples 113, 213 and second heat transfer surface 102, 202 dimples 114, 214.

Preferably, the channel 117, 217 comprises a first, upstream (with respect to the flow direction of the first medium through the channel 117, 217) portion 117*b*, 217*b* of the channel 117, 217; an intermediary portion 117*c*, 217*c* of the channel 117, 217; and a second, downstream portion 117*d*, 217*d* of the channel 117, 217. The intermediary portion 117*c*, 217*c* is arranged between the upstream 117*b*, 217*b* and downstream 117*d*, 217*d* portions, arranged to convey the first medium around the second medium inlet port 111, 211. Further preferably, each of the first 117*b*, 217*b* and the second 117*d*, 217*d* portions comprise both first heat transfer surface 101, 201 dimples 113, 213 and second heat transfer surface 102, 202 dimples 114, 214, while the intermediary portion 117*c*, 217*c* comprises at least 80%, preferably only, first heat transfer surface 101, 201 dimples 113, 213. Preferably, there are a number of first heat transfer surface 101, 201 dimples 118, 218 arranged around the second medium inlet 111, 211, preferably arranged equidistantly and surrounding the second medium inlet 111, 211, preferably at equal distance from the inlet 111, 211 periphery. Preferably, a dimple-free channel 118*a*, 218*a* is defined outside of the dimples 118, 218, between the dimples 118, 218 and the periphery of the plate 100, 200, for allowing uninterrupted flow of the first medium.

This provides a sturdy, compact construction while still maintaining sufficient heat transfer.

Similarly, a number of first heat transfer surface 101, 201 dimples 119, 219 are arranged around the first medium outlet 112, 212. The dimples 119, 219 are preferably arranged equidistantly and surrounding the first medium outlet 112, 212, preferably at equal distance from the outlet 121, 212.

According to a very preferred embodiment, the plates 100, 200 together forming a heat exchanger by being brazed together in the stack structure described above, so that corresponding ones of said dimples and ridges of adjacent, mirrored plates 100, 200 are brazed together, top face against top face. This forms a very sturdy construction, without risking the integrity of the complicated channels formed between said ridges and dimples. In particular, the plates 100, 200 are preferably manufactured from stainless steel, and are brazed together using copper or nickel; or alternatively the plates 100, 200 may be manufactured from aluminium, and brazed together using aluminium. In practise, plates 100, 200 are arranged in the said stack structure, with brazing foil material in between. Then, the whole stack is subjected to heat in a furnace, causing the brazing material to melt and permanently join the plates 100, 200 together via the above described dimples and ridges.

In particular, such a heat exchanger according to the invention may preferably be a closed counter flow heat exchanger, comprising a first medium inlet port 353 arranged to distribute the first medium to the respective first medium channels 203 in contact with said first surfaces 201 of said plates 200; a first medium outlet port 351 arranged to lead the first medium from said first channels 203 in contact with said first surfaces 201 and out from the heat exchanger; a second medium inlet port 350 arranged to distribute the second medium to the respective second medium channels 204 in contact with the second surfaces 202 of said plates; and a second medium outlet port 352 arranged to lead the second medium from said second medium channels 204 in contact with the second surfaces 202 and out from the heat exchanger. The corresponding is true regarding a heat exchanger using plates 100 as shown in FIGS. 1-4.

In particular, and as mentioned above, the heat exchanger is a condenser-type heat exchanger, arranged to heat exchange the first medium in gas phase to the second medium, so that the first medium condenses, preferably fully condenses, into liquid form. In this case, it is preferred that the heat exchanger is arranged so that the condensed, liquid first medium thereafter flows out from the first medium outlet port 351, preferably after being cooled below a condensation temperature of the first medium, preferably at least 3° C. below, most preferably between 3° and 7° C. below, such condensation temperature, in a subcooling region as described above.

In particular, the present invention is useful in the specific case in which the first medium is a refrigerant, preferably a hydrocarbon, preferably propane. Similarly, the second medium may preferably be a liquid, preferably water.

Preferred uses of such a heat exchanger comprise use as a heat exchanger in a cooling apparatus, such as a freezer or refrigerator; in a heat pump for heating indoors air, water or similar in a property; for industrial heat exchanging and refrigeration purposes, such as within the food industry; and so on.

Preferably, a heat exchanger according to the invention is maximally 1 meter in its longest dimension.

Figure 8:
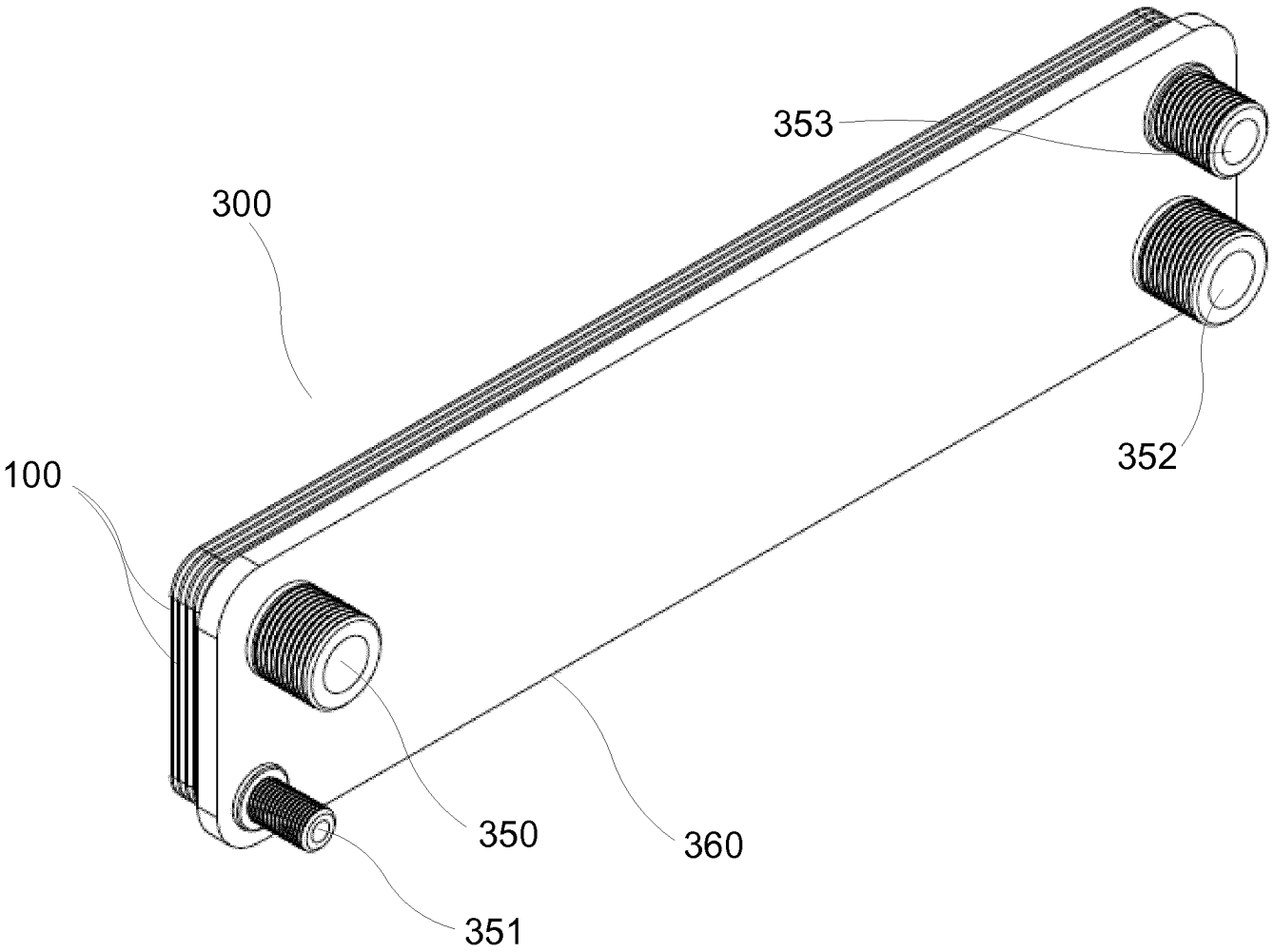
FIG. 8 is a perspective view of a heat exchanger according to the invention.
Figure 9:
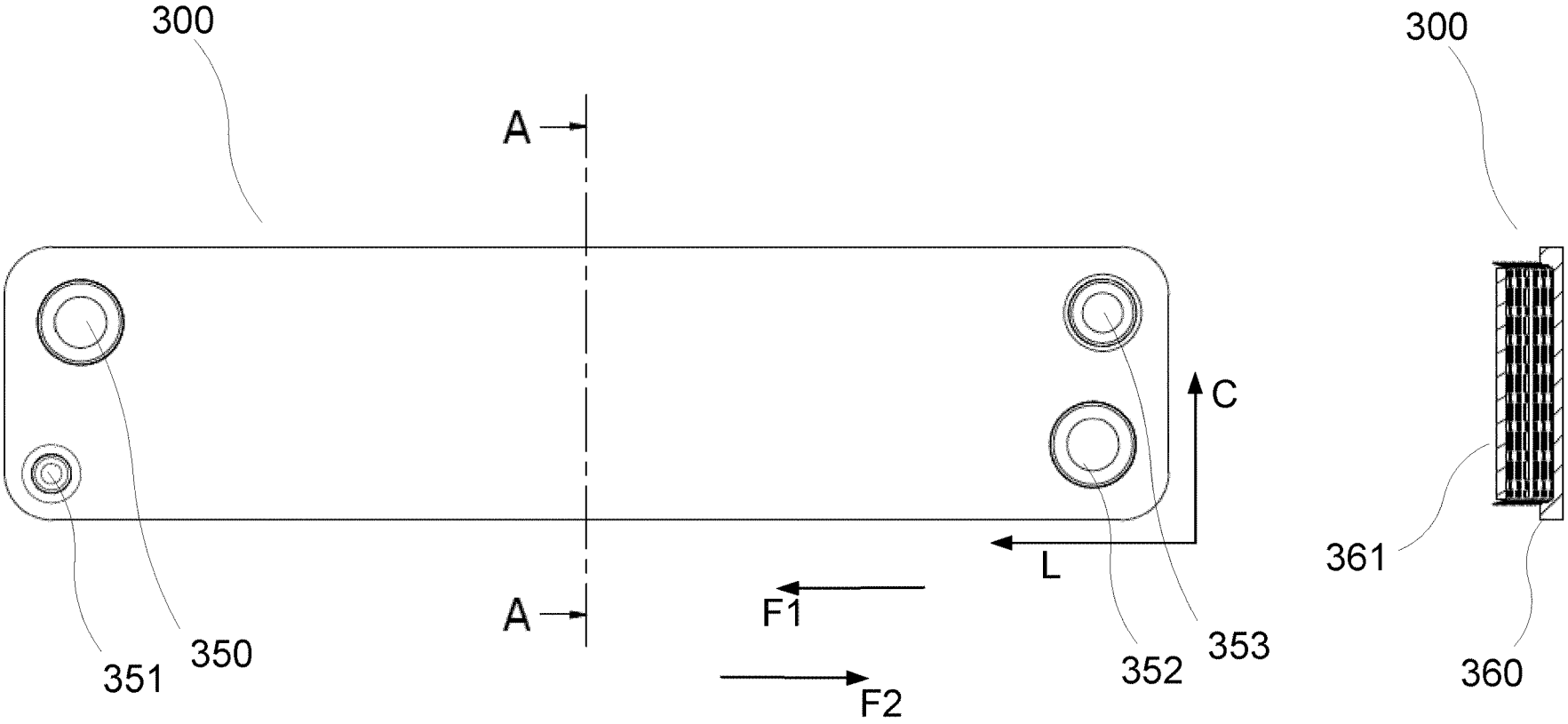
FIG. 9 is a top planar view of the heat exchanger shown in FIG. 8, with a section A-A illustrated.

FIGS. 8 and 9 show a heat exchanger 300, comprising a plurality (in the example shown, ten) heat exchanging plates 100 of the type illustrated in FIGS. 1-4 and described above. The plates 100 are stacked one on top of the other, with every other plate 100 being mirrored with respect to its adjacent neighbouring plates, also as described above. It is noted that the bent edge 205 of each plate 200 is not mirrored in the heat exchanger 300.

The first medium enters the heat exchanger 300 via a first medium inlet port 353, in communication with all the channels formed between respective adjacent pairs of plates 100, and delimited by their respective first surfaces 101. Preferably, these channels are parallel, so that the first medium flows in parallel flows along the first flow direction F1. The first medium is then collected from these channels and exit via a first medium outlet port 351.

The second medium enters the heat exchanger 300 via a second medium inlet port 350, in communication with all the channels formed between respective adjacent pairs of plates 100, and delimited by their respective second surfaces 102. Preferably, these channels are parallel, so that the second medium flows in parallel flows along the second flow direction F2. The second medium is then collected from these channels and exit via a second medium outlet port 352.

It is hence realized that the flow of both the first and second media flow in a parallel-flow manner, through a plurality of channels of said type, between pairs of individual plates 100 in said stack, between respective inlet and outlet ports.

As best seen in FIG. 9, the heat exchanger 300 also comprises end plates 360, 361 for delimiting the said channels on each extreme end of the plate 100 stack, guaranteeing that the heat exchanger 300 is entirely closed, and liquid and gas tight, apart from ports 350-353.

Above, preferred embodiments have been described. However, it is apparent to the skilled person that many modifications can be made to the disclosed embodiments without departing from the basic idea of the invention.

In general, the above described features of the plates 100, 200 and heat exchangers are freely combinable, as applicable.

Everything which has been said regarding plates 100, 200 and 400 is interchanglingly useful for to the other plates, as applicable. Hence, the plate 200 may for instance also be arranged with a bent edge 107 as shown in plate 100, and so on.

The specific patterns of dimples and ridges illustrated in the Figures may vary, as long as the above-described design principles are respected. This is particularly true regarding the subcooling structure channel 117, 217 and its associated dimples 113, 118, 119, 213, 218, 219.

As an example, in the figures there are two cooperating ridges 115, 116; 215, 216 that together form the channel 117; 217. Even if this configuration is preferred, it would, however, be possible to use only one barrier. For instance, the barrier 116; 216 could be omitted, or perhaps be replaced with a dense set of first-surface dimples.

Hence, the invention is not limited to the described embodiments, but can be varied within the scope of the enclosed claims.

The invention claimed is:

1. A plate for heat exchange between a first medium and a second medium, the plate including a main plane of extension and a main longitudinal direction and comprising:

a first heat transfer surface, extending in parallel to said main plane and arranged to be in contact with the first medium, generally flowing along the first heat transfer surface in a first flow direction; and a second heat transfer surface, extending in parallel to said main plane and arranged to be in contact with the second medium, generally flowing along the second heat transfer surface in a second flow direction, wherein the first heat transfer surface comprises a first medium inlet region, a first medium transfer region and a first medium outlet region, the first medium outlet region comprising a first medium outlet port, wherein the second heat transfer surface comprises a second medium inlet region, a second medium transfer region and a second medium outlet region, the second medium inlet region overlapping, in the main longitudinal direction, with the first medium outlet region and comprising a second medium inlet port, wherein the first medium outlet region comprises at least one protruding ridge extending from an edge of the first heat transfer surface opposite to the first medium outlet port, and extending toward the first medium outlet port along a direction having at least a component perpendicular to said main longitudinal direction, and wherein said at least one protruding ridge forms a barrier system for the first medium and defines a channel along which the first medium is forced to travel in said main plane, from the first medium transfer region to the first medium outlet port, the channel running first towards, then around and thereafter away from the second medium inlet port, so that all of the first medium travelling from the first medium transfer region up to and out from the first medium outlet port is forced to travel around the second medium inlet port.

2. The plate according to claim 1, wherein said channel has a flow cross-section at least 3 times smaller than a total flow cross-section for the first medium immediately upstream of the channel, so that the first medium flow velocity is higher when passing through the channel as compared to immediately upstream of the channel.

3. The plate according to claim 1, wherein said channel has a flow cross-section at least 5 times smaller than a total flow cross-section for the first medium immediately upstream of the channel, so that the first medium flow velocity is higher when passing through the channel as compared to immediately upstream of the channel.

4. The plate according to claim 1, wherein the channel, along a majority of a length thereof is between 5 and 30 mm wide.

5. The plate according to claim 1, wherein the channel, along a majority of a length thereof is between 8 and 20 mm wide.

6. The plate according to claim 1, wherein both the first and second heat transfer surfaces comprise respective dimples, and wherein a first, upstream portion of the channel as well as a second, downstream portion of the channel, each comprises both first heat transfer surface dimples and second heat transfer surface dimples, but that an intermediary portion of the channel, arranged between said upstream and downstream portions, conveying the first medium around the second medium inlet port, comprises only first heat transfer surface dimples.

7. The plate according to claim 6, wherein the respective height, perpendicular to the main plane, of said dimples and ridges define a first flow height for the first medium and a second flow height for the second medium, and wherein the second flow height is at least 2 times larger than the first flow height.

8. The plate according to claim 6, wherein the respective height, perpendicular to the main plane, of said dimples and ridges define a first flow height for the first medium and a second flow height for the second medium, and wherein the second flow height is at least 5 times larger than the first flow height.

9. The plate according to claim 7, wherein the first flow height is at the most 2 mm.

10. The plate according to claim 7, wherein the first flow height is at the most 1 mm.

11. The plate according to claim 7, wherein the first flow height is at the most 0.5 mm.

12. A heat exchanger comprising a plurality of plates of a first and a second type, the plates of both said first and said second type being plates according to claim 1, and both the first and second heat transfer surfaces comprise respective dimples extending therefrom, but wherein the plates of said second type have a shape substantially mirrored to the shape of the plates of said first type, the plates of said first and second type being arranged in a stack on top of each other, with plates of said first and second type arranged alternatingly, whereby corresponding ones of dimples and ridges of adjacent plates come and stay into direct contact with each other, so that corresponding first and/or second surfaces of adjacent plates abut each other and so that flow channels for said first and second media are formed between said surfaces.

13. The heat exchanger according to claim 12, wherein the plates are brazed together, so that corresponding ones of said dimples and ridges of adjacent, mirrored plates are brazed together.

14. The heat exchanger according to claim 12, wherein the heat exchanger is a closed counter flow heat exchanger, comprising:

a first medium inlet port arranged to distribute the first medium to the respective first heat transfer surfaces of said plates;

said first medium outlet port arranged to lead the first medium from said first heat transfer surfaces and out from the heat exchanger;

said second medium inlet port arranged to distribute the second medium to the respective second heat transfer surfaces of said plates; and a second medium outlet port arranged to lead the second medium from said second heat transfer surfaces and out from the heat exchanger.

15. The heat exchanger according to claim 12, wherein the heat exchanger is a condenser, arranged to heat exchange the first medium in gas phase to the second medium so that the first medium condenses, and arranged so that the condensed, liquid first medium thereafter is first cooled, while flowing through the channel below a condensation temperature of the first medium, and thereafter flows out from the first medium outlet.

16. The heat exchanger according to claim 15, wherein the first medium is a hydrocarbon.

17. The heat exchanger according to claim 15, wherein the second medium is a liquid.

18. The plate according to claim 1, wherein the first medium outlet region includes at least one protruding ridge extending from an edge of the first heat transfer surface adjacent the first medium outlet port, and extending away from the first medium outlet port along a direction having at least a component perpendicular to said main longitudinal direction.

19. A plate for heat exchange between a first medium and a second medium, the plate including a main plane of extension and a main longitudinal direction and comprising:

a first heat transfer surface, extending in parallel to said main plane and arranged to be in contact with the first medium, generally flowing along the first heat transfer surface in a first flow direction; and a second heat transfer surface, extending in parallel to said main plane and arranged to be in contact with the second medium, generally flowing along the second heat transfer surface in a second flow direction, wherein the first heat transfer surface comprises a first medium inlet region, a first medium transfer region and a first medium outlet region, the first medium outlet region comprising a first medium outlet port, wherein the second heat transfer surface comprises a second medium inlet region, a second medium transfer region and a second medium outlet region, the second medium inlet region overlapping, in the main longitudinal direction, with the first medium outlet region and comprising a second medium inlet port, wherein the first medium outlet region comprises at least one protruding ridge extending from an edge of the first heat transfer surface along a direction having at least a component perpendicular to said main longitudinal direction, and wherein said at least one protruding ridge forms a barrier system for the first medium and defines a channel along which the first medium is forced to travel in said main plane, from the first medium transfer region to the first medium outlet port, the channel running first towards, then around and thereafter away from the second medium inlet port, so that all of the first medium travelling from the first medium transfer region up to and out from the first medium outlet port is forced to travel around the second medium inlet port, wherein the plate comprises a first side edge and a second, opposite, side edge, the first and second side edges being arranged at a distance from each other in a cross direction, perpendicular to the main longitudinal direction and parallel to the main plane, wherein the first medium outlet port is arranged closer to the first side edge than the second medium inlet port, wherein the at least one protruding ridge comprises a distal ridge running from the first side edge up to the second medium inlet port and a proximal ridge running from the second side edge towards but not up to the first side edge, wherein the proximal ridge is arranged closer to the first medium transfer region than the distal ridge, and wherein the distal ridge is arranged between the first medium outlet port and the first medium transfer region.

20. The plate according to claim 19, wherein the distal ridge is curved along at least one portion of the channel, so as to generally follow the contour of the first medium outlet port.

21. The plate according to claim 19, wherein the proximal ridge is curved along at least one portion of the channel, so as to generally follow the contour of the second medium inlet port.

22. A plate for heat exchange between a first medium and a second medium, the plate including a main plane of extension, a main longitudinal direction and a width direction, perpendicular to the main longitudinal direction, a length of the plate in the main longitudinal direction being longer than in the width direction, the plate comprising:

a first heat transfer surface, extending in parallel to said main plane and arranged to be in contact with the first medium, generally flowing along the first heat transfer surface in a first flow direction; and a second heat transfer surface, extending in parallel to said main plane and arranged to be in contact with the second medium, generally flowing along the second heat transfer surface in a second flow direction, wherein the first heat transfer surface comprises a first medium inlet region, a first medium transfer region and a first medium outlet region, the first medium outlet region comprising a first medium outlet port, wherein the second heat transfer surface comprises a second medium inlet region, a second medium transfer region and a second medium outlet region, the second medium inlet region overlapping, in the main longitudinal direction, with the first medium outlet region and comprising a second medium inlet port, wherein the first medium outlet region comprises at least one protruding ridge extending from an edge of the first heat transfer surface along a direction having at least a component perpendicular to said main longitudinal direction, and wherein said at least one protruding ridge forms a barrier system for the first medium and defines a channel along which the first medium is forced to travel in said main plane, from the first medium transfer region to the first medium outlet port, the channel running first towards, then around and thereafter away from the second medium inlet port, so that all of the first medium travelling from the first medium transfer region up to and out from the first medium outlet port is forced to travel around the second medium inlet port.

* * * * *